US005207051A

United States Patent [19]

Inger et al.

[11] Patent Number: 5,207,051

[45] Date of Patent: May 4, 1993

[54] APPARATUS FOR TRANSFERRING FULL BOBBINS AND EMPTY BOBBINS BETWEEN A BOBBIN WINDING MACHINE AND A TRANSPORTING MECHANISM

[75] Inventors: Siegfried Inger, Tönisvorst; Wolfgang Leupers, Mönchengladbach, both of Fed. Rep. of Germany

[73] Assignee: Palitex Project Company GmbH, Krefeld, Fed. Rep. of Germany

[21] Appl. No.: 925,562

[22] Filed: Aug. 4, 1992

Related U.S. Application Data

[63] Continuation of Ser. No. 609,820, Nov. 6, 1990, abandoned.

[30] Foreign Application Priority Data

Nov. 7, 1989 [EP] European Pat. Off. ..... 89120539.5

[51] Int. Cl.[5] ..... D01H 9/14; B65H 54/02

[52] U.S. Cl. ..... 57/281; 57/58.54; 57/90; 57/266; 57/276; 198/465.1; 242/35.5 A

[58] Field of Search ..... 198/465.1, 487.1; 242/803.12, 35.5 A, 35.6 E; 57/266, 281, 90, 58.52, 58.54; 414/276, 911

[56] References Cited

U.S. PATENT DOCUMENTS

| | | | |
|---|---|---|---|
| 1,991,699 | 2/1935 | Reiners et al. | 198/487.1 X |
| 3,773,190 | 11/1973 | Ishida et al. | 198/346.1 |
| 4,289,228 | 9/1981 | Reim et al. | 198/346.1 |
| 4,571,931 | 2/1986 | Kupper | 57/281 |
| 4,586,326 | 5/1986 | Igel | 57/281 |
| 4,601,434 | 7/1986 | Mori et al. | 242/35.6 E |
| 4,776,468 | 10/1988 | Kiriake | 242/35.5 A X |
| 4,813,222 | 3/1989 | Fukuda et al. | 57/266 X |
| 4,848,076 | 7/1989 | Ueda et al. | 57/281 |
| 4,848,077 | 7/1989 | Kawarabashi et al. | 57/281 |
| 4,899,530 | 2/1990 | Morrison | 57/266 X |
| 4,928,476 | 5/1990 | Otoshima et al. | 57/281 X |
| 4,978,081 | 12/1990 | Kupper | 57/276 X |
| 4,979,360 | 12/1990 | Kaumann et al. | 57/281 |
| 4,998,407 | 3/1991 | Matsui et al. | 57/281 X |
| 5,011,000 | 4/1992 | Rawasaki et al. | 242/35.5 A X |
| 5,082,192 | 1/1992 | Langen et al. | 242/18 R |

FOREIGN PATENT DOCUMENTS

| | | | |
|---|---|---|---|
| 0026160 | 9/1980 | European Pat. Off. . | |
| 2225673 | 11/1972 | Fed. Rep. of Germany . | |
| 2263333 | 11/1987 | Japan | 57/281 |

*Primary Examiner*—Daniel P. Stodola
*Assistant Examiner*—William Stryjewski
*Attorney, Agent, or Firm*—Bell, Seltzer, Park & Gibson

[57] ABSTRACT

A bobbin transfer apparatus simultaneously transfers consecutive individual adapters having at least one fully wound bobbin of yarn thereon and consecutive individual adapters having at least one substantially empty bobbin of yarn thereon between a yarn bobbin winding machine adjacent the transfer apparatus and a bobbin suspension transporting mechanism positioned over the transfer apparatus for consecutively moving full bobbins from the transfer apparatus to a yarn processing machine and returning substantially empty bobbins therefrom to the transfer apparatus. The transfer apparatus includes a conveying device for consecutively conveying the individual adapters in a generally vertical position through a closed path of travel. The transfer apparatus also includes three work stations positioned in the path of travel of the conveying device and in which devices are provided in the first work station for moving upwardly to carry an adapter with a full bobbin thereon from the transfer apparatus to the transporting mechanism and to receive an adapter with a substantially empty bobbin thereon from the transporting mechanism and carry the same to the transfer apparatus. The second and third work stations provide devices for, preferably simultaneously, consecutively removing the empty bobbins from the adapters and mounting fully wound bobbins from the winding machine on the empty adapters for return to the first work station to be conveyed to the transporting apparatus.

11 Claims, 5 Drawing Sheets

APPARATUS FOR TRANSFERRING FULL BOBBINS AND EMPTY BOBBINS BETWEEN A BOBBIN WINDING MACHINE AND A TRANSPORTING MECHANISM

This application is a continuation of application Ser. No. 609,820, filed Nov. 6, 1990, now abandoned.

FIELD OF INVENTION

The invention relates to a device for transferring on the one hand individual bobbins slipped onto a bobbin adapter from e.g. a winding machine to a bobbin transportation mechanism and on the other hand empty bobbin sleeves from the transportation mechanism to the winding machine. The bobbin transportation mechanism can be associated with a further-processing textile machine, for example a winding or multiple spooling machine or a two-for-one twisting machine or be part of such a further-processing textile machine.

BACKGROUND, OBJECT AND SUMMARY OF THE INVENTION

A transfer device described in EP 0 026 160 serves for combining in each case two axially aligned individual bobbins, lying one behind the other, by means of a bobbin adapter into a bobbin group, which is then allowed to drop under the influence of the force of gravity into a store or a collecting wagon cart. The individual bobbin adapters are previously removed from a bobbin magazine. For the further processing the bobbin units deposited in the store or collecting wagon have to be grasped afresh once again, in which respect for the careful removal of these bobbin units from the bobbin magazine in practice only a removal by hand is suitable.

U.S. Pat. No. 4,848,076 deals with a bobbin transfer or respectively bobbin transposing device for connecting an automatic winding machine to a two-for-one twisting machine. It is a matter, in this respect, more especially of a device in the case of which the bobbins are removed by means of a gripper from a conveyor belt associated with the winding machine and after variation of the axial position of the delivered on bobbins carriers of a conveyor belt revolving about the two-for-one twisting machine.

U.S. Pat. No. 4,586,320 deals with a transfer device which is associated with a ring spinning machine and by which roving bobbins are removed from a bobbin transportation wagon and are slipped onto a transportation mechanism extending along the bobbin gate of the ring twisting machine.

As a result of the invention the problem is to be solved of coupling a winding machine in such a way with a subsequent further-processing textile machine, for example two-for-one twisting machine, that with low expenditure on the one hand completely wound bobbins are transferred from the winding machine to the subsequent machine, whilst on the other hand empty sleeves conveyed back from this subsequent machine are supplied again to the winding machine.

In accordance with this invention, a bobbin transfer apparatus is provided for simultaneously transferring consecutive individual adapters having at least one fully wound bobbin of yarn thereon and consecutive individual adapters having at least one substantially empty bobbin of yarn thereon between a yarn bobbin winding machine adjacent the transfer apparatus and a bobbin suspension transporting mechanism positioned over the transfer apparatus for consecutively moving full bobbins from the transfer apparatus to a yarn processing machine and returning substantially empty bobbins therefrom to the transfer apparatus.

The transfer apparatus includes means for consecutively conveying the individual adapters in a generally vertical position through a closed path of travel. The apparatus further includes a first work station means positioned in the conveying means including means for moving up and down between the conveying means and the bobbin suspension transporting mechanism for consecutively receiving and carrying adapters with a full yarn bobbin thereon from the conveying means to the transporting mechanism during upward movement thereof and for consecutively receiving and carrying adapters with a substantially empty bobbin thereon from the transporting mechanism to the conveying means during downward movement thereof. A second work station means is positioned in the conveying means for consecutively receiving the adapters with the substantially empty bobbin from the first work station means and for removing the substantially empty bobbin from the adapters for return to the winding machine. A third work station means is positioned in the conveying means for consecutively receiving the empty adapters from the first work station means and for mounting a fully wound bobbin of yarn from the winding machine onto the empty adapters, preferably simultaneously with removal of the empty bobbins from the adapters in the second work station means, so that the adapters with the full bobbin thereon may be conveyed by the conveying means to the first work station means for transfer to the transporting mechanism.

The conveying means of the transfer apparatus preferably includes a guide rail in the shape of the closed path of travel, a plurality of carriages mounted for consecutive movement on and around the guide rail and each including a generally vertically-extending mandrel for extending into and carrying an individual adapter, and means for driving the respective carriages around the guide rail and to each of the work stations. The means for driving the respective carriages around the guide rail may comprise a driven endless conveyor belt positioned within the guide rail and individual coupling devices extending from the conveyor belt to each of the carriages.

The second and third work station means preferably include respective opposite ends of an independent section of the guide rail adapted to receive one of the carriages with an adapter having a substantially empty bobbin thereon on the first end of the independent guide rail section in the second work station means and one of the carriages with an empty adapter having the bobbin removed on the second end of the independent guide rail section in the third work station means. Means are provided for mounting and pivoting the independent guide rail section and carriages thereon approximately 90° degrees from its conveying position so that the adapters in the second and third work station means will be positioned generally horizontal. Means are also provided for mounting and moving the guide rail section after the pivoting movement thereof in a linear reciprocating forward and reversed generally horizontal direction. Means are provided to remove the substantially empty bobbin from the adapter in the second work station means during the horizontal reciprocating movement of the guide rail section and means are provided for positioning a fully wound bobbin on the empty adapter in the third work station means during the horizontal reciprocating movement of the guide rail section. The means for mounting and pivoting the guide rail section may comprise a driven crank and lever device connected to the pivotally mounted guide rail section. The means for mounting and moving the guide rail section in the reciprocating forward and reverse generally horizontal direction may comprise a horizontally-extending roller and rail device mounting the guide rail section and a fluid-operated piston and cylinder mechanism connected thereto for operation thereof.

The means to remove the substantially empty bobbin from the adapter in the second work station means may include a clamp device for clamping the substantially empty bobbin during the forward movement of the guide rail section and for releasing the bobbin after rearward movement of the guide rail section, and a magazine for receiving the bobbin after release by the clamp device. There may also be provided means for removing the substantially empty bobbin from the magazine, for cutting and removing the residual yarn from the bobbin and for releasing the totally empty bobbin to the winding machine. The means for positioning a fully wound bobbin on the empty adapter in the third work station means may include a device for receiving fully wound bobbins form the winding machine in a generally horizontal position and positioning such bobbin at an elevation for receipt of the empty adapter therein during the forward movement of the guide rail section.

The means for moving up and down of the first work station means preferably includes a further independent guide rail section for receiving one of the carriages and mounted for up and down movement from and to the remaining portion of the guide rail, and drive means for effecting such up and down movement. The bobbin transfer apparatus may also include a fourth work station means for consecutively receiving the adapters with at least one full bobbin of yarn thereon form the third work station means before conveying thereof to the first work station means and for grasping and positioning the loose yarn in from the bobbin at a desired position on the adapter for further handling.

BRIEF DESCRIPTION OF THE DRAWINGS

The invention will be described in more detail hereinunder with reference to the drawings.

DETAILED DESCRIPTION OF PREFERRED EMBODIMENT OF THE INVENTION

The operating method in accordance with the invention emerges from the following description of the bobbin transfer device in accordance with the invention. The mechanical and constructional details of the bobbin transfer device will be described hereinunder substantially in connection with the manner of working and functioning of the individual units.

Figure 1:
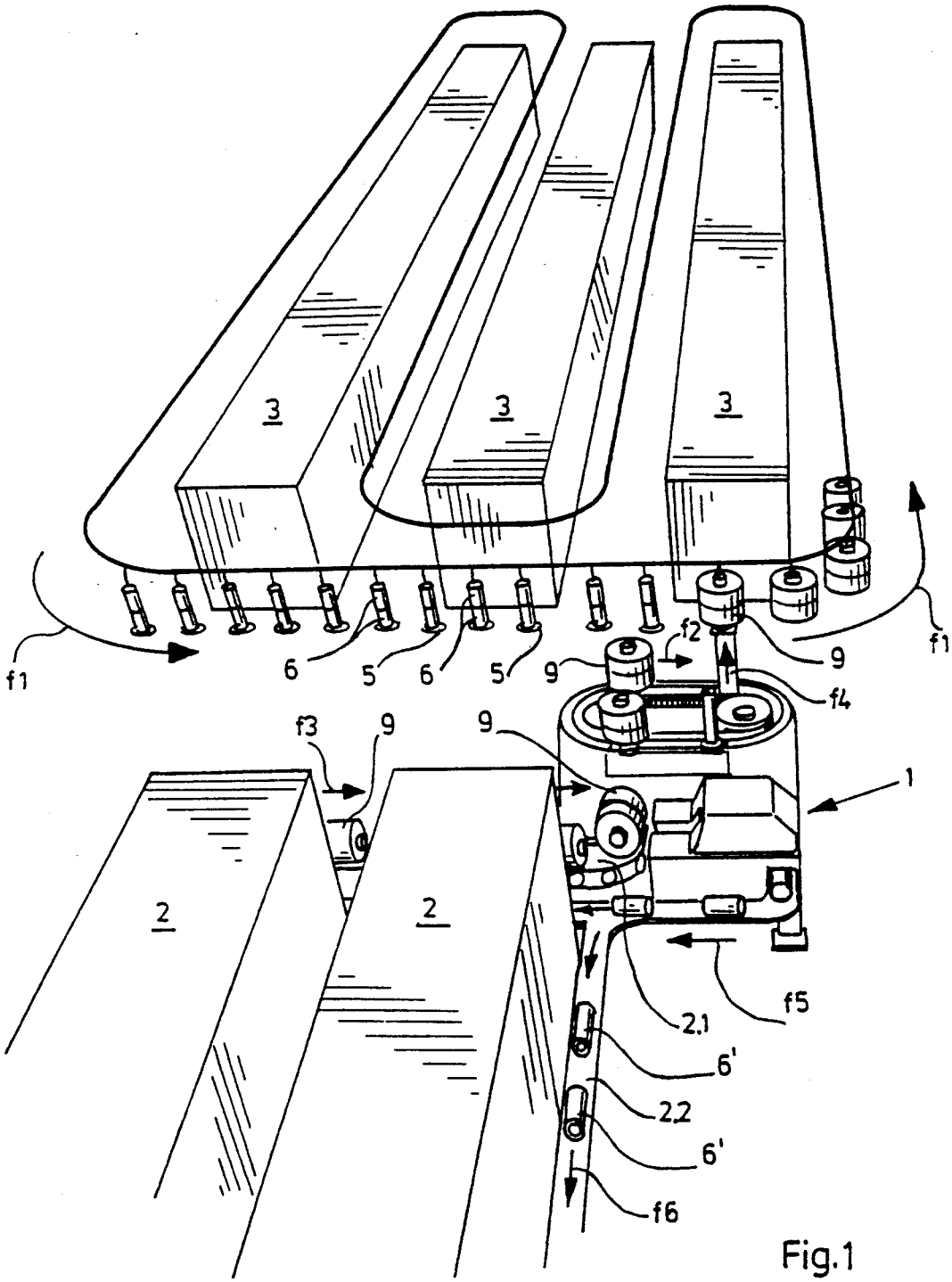
FIG. 1 shows in diagrammatic representation an arrangement of the machine groups, that are to be connected, with an interpolated transfer device in accordance with the invention.

FIG. 1 shows in diagrammatic representation the bobbin transfer device 1 in accordance with the invention as connection and coupling member between diagrammatically represented winding machines 2 or multiple spooling machines or spinning machines and likewise diagrammatically represented further-processing textile machines 3, in the case of which it can for example be a matter of two-for-one twisting machines. Both in the case of the winding machines 2 and in the case of the textile machines 3 it is a matter of so-called multi-location machines. In accordance with FIG. 1 associated with the winding machines 2 is a conveyor belt 2.1 with which completely wound yarn bobbins 9 are supplied to the transfer device 1.

These yarn bobbins 9 are transferred from the transfer device 1 to a suspension conveyor mechanism 4, by means of which the yarn bobbins 9 slipped onto bobbin adapters 5 are transferred to the overhead conveying mechanism 4 running around the textile machine 3. The yarn bobbins are processed in the region of the individual work locations of the textile machines, so that the empty sleeves 6 slipped onto the bobbin adapters 5 then have to be conveyed away again. This conveying away is effected likewise by means of the overhead conveying mechanism 4, from by which the bobbin adapters 5 with the empty sleeves 6 slipped thereon are removed again by means of the transfer device 1. The empty sleeves are then removed in the region of this transfer device from the bobbin adapters 5, in the appropriate circumstances cleaned of residual yarn residues and then transferred to a conveying mechanism 2.2, by which the cleaned empty sleeves 6' are distributed to the individual work locations of the winding machine 2.

The direction of movement of the individual conveying mechanisms is indicated in FIG. 1 by the arrows f1–f6.

Figure 2:
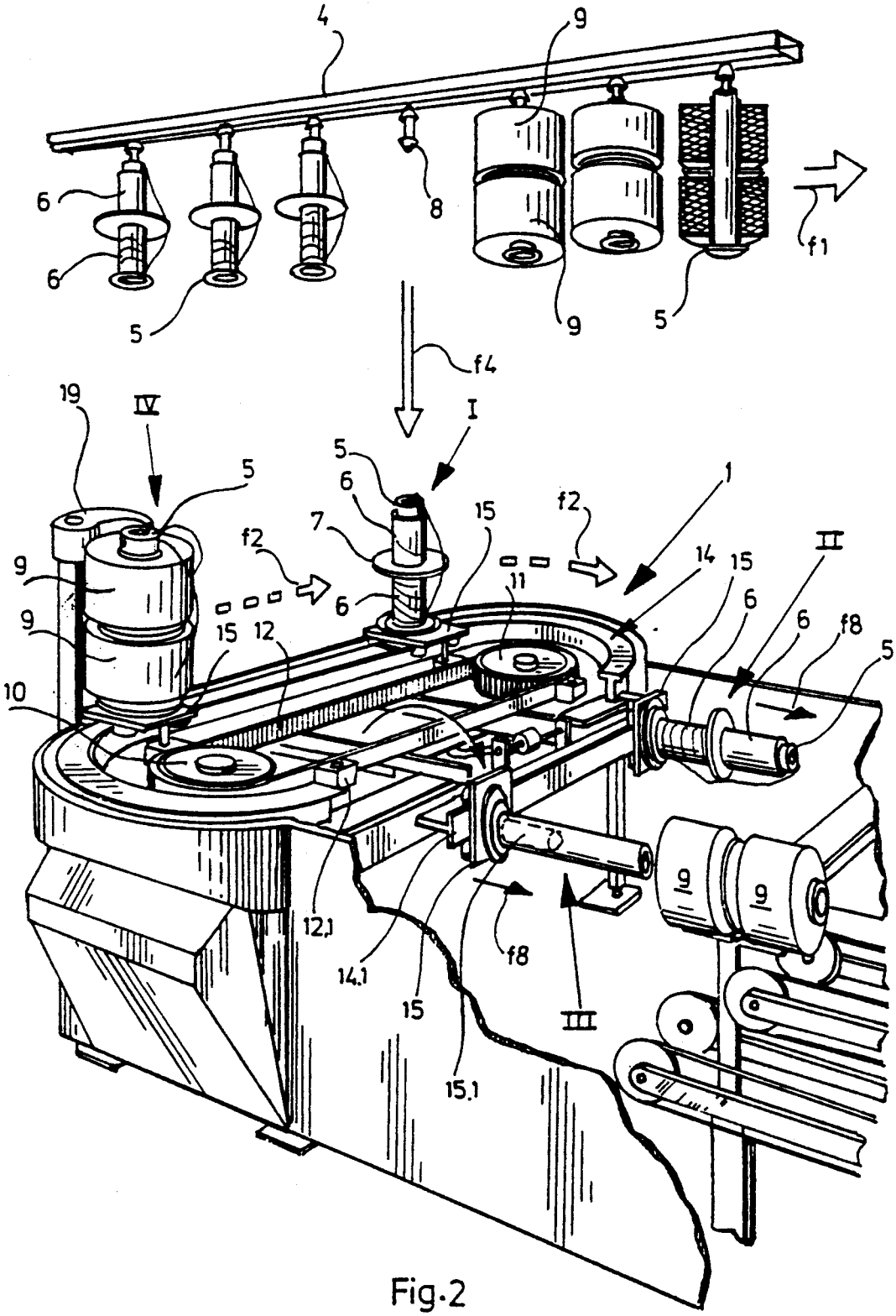
FIG. 2 shows partially in section an isometric representation of the bobbin transfer device in accordance with the invention.

In accordance with FIG. 2 the overhead conveying mechanism 4 comprises an upper rail in which a conveying chain or a conveyor belt is guided, to which bobbin suspension holders 8 are fastened at uniform intervals. The bobbin adapters 5 and the bobbin suspension holders 8 are in known manner so designed that the bobbin adapter as a result of adequate raising relative to the bobbin suspension holder 8 on the one hand is released from this and on the other hand is grasped thereby.

In accordance with FIGS. 2, 3, 4 and 6 the bobbin transfer device 1 contains substantially the following functionally-essential component parts: Two guide wheels 10 and 11 revolving about vertical axes for an endless transportation member in the form of a conveyor belt 12, in which respect the one guide wheel 11 is driven by a driving unit 13; a guide rail 14 in the form of a T-profile which surrounds the transportation member 12 and is arranged running parallel to this, in which respect this guide rail 14 contains an elongate outwardly swivellable rail portion 14.1, and a rail portion 14.2 which is adjustable in the vertical direction (see FIG. 6);

entrainment means, guided on the guide rail 14, in the form of carriages 15 (in the present instance four carriages), which carry bobbin carriers in the form of slip-in mandrels 15.1 for the slipping-on of the bobbin adapters and have rollers 15.2, with which the carriages 15 are guided on the guide rail, engaging behind the T-limbs of the T-profile of the guide rail 14; on the one hand coupling members 12.1 fastened to the transportation member 12 and on the other hand coupling members 15.3 positioned on the carriages 15, Which can co-operate with the coupling members 12.1, in order to couple the carriages 15 with the transportation member 12, in such a way that the carriages can be moved forward along the guide rail 14 in the direction of the arrows f2; an adjusting system 16, yet to be described in detail, in order to be able to swivel the swivellable rail portion 14.1 on the one hand in the direction of the arrow f7 (see FIG. 4) and on the other hand to move same in the direction of the arrow 8 to and fro in the horizontal direction; a lifting unit in the form of a lifting cylinder 17, in order to adjust the rail portion 14.2, movable up and down, in the direction of the arrows or respectively double arrows f4 in the vertical direction.

FIG. 2 shows the bobbin transfer device 1 partially in section. There can be seen the ovally conducted guide rail 14 with the rhythmically drivable transportation member 12, in order to supply the carriages 15 with the bobbin or sleeve groups superimposed onto the slip-in mandrels 15.1 timely to the individual work locations. The overhead conveying mechanism 4 is shown above the transfer device 1.

The work stations along the guide rail 14 are in the clockwise direction described as follows: In the work station 1 a bobbin adapter 5 with the empty sleeves 6 slipped thereon is removed from a bobbin suspension holder 8 of the suspended conveying mechanism 4. Between the two bobbin sleeves 6 placed one above the other there is situated a disc-shaped run-off aid 7. This serves to improve the run-off behavior of the threads from the two singly wound bobbins in the region of the further-processing textile machine.

The second work station II is situated at the entry end of the swivellable rail portion 14.1, whilst the third work station III is arranged in the region of the exit end of this rail portion 14.1. In the second work station the carriages 15 and the bobbin adapters 5, slipped thereon, with the empty or partially empty bobbin sleeves 6 present thereon are swivelled in a horizontal position. In the work station II the empty sleeves 6 are in the appropriate circumstances together with the run-off aid 7 stripped off from the bobbin adapter 5. This procedure will be yet described in detail.

In the third work station III the yarn bobbins 9 transferred from the conveyor belt 2.1 to a lifting table 18 are taken over by the empty bobbin adapter 5. For the removal of the empty sleeves in the work station II and for the take-over of full yarn bobbins in the work station III, the swivellable rail portion 14.1 is swivelled in the direction of the arrow f8 in a horizontal direction, namely driven by the adjusting system 16.

After the guide rail 14, as a result of setting-back of the rail portion 14.1, is again closed, the bobbin adapter, equipped with full yarn bobbins 9, together with the carriage 15 can be adjusted into the work station IV. In accordance with FIG. 2, associated with this work station IV is a suction mechanism 19 which can be placed up to the bobbin periphery and with which the thread ends of the two bobbins 9 are sought and grasped, in order to locate these thread ends in a suitable manner for example at the upper edge of the bobbin adapter 5.

Then this prepared bobbin group is moved into the work position I, in order to transfer this bobbin group, as a result of running-up of the rail portion 14.2, to a free bobbin suspension holder 8 of the suspension conveying mechanism 4.

Fastened to this rail portion 14.2 which can be moved, up and down is a vertical rail 21 which is guided between lateral guide rollers 20 and on which the lifting mechanism 17 acts.

After the transfer of a new bobbin group to the suspension conveying mechanism, the carriage 15 remains in a height position shortly below the suspension conveying mechanism. This then steps on by one graduation, so that a following bobbin adapter 5 with empty sleeves superimposed thereon can be removed by running-up of the carriage 15, in order to transfer this bobbin holder, equipped with empty sleeves, after running-down of the carriage 15 or respectively of the rail portion 14.2 into the circuit, so that afresh the work cycle described with reference to the Work positions II to IV can be carried out.

Figure 3:
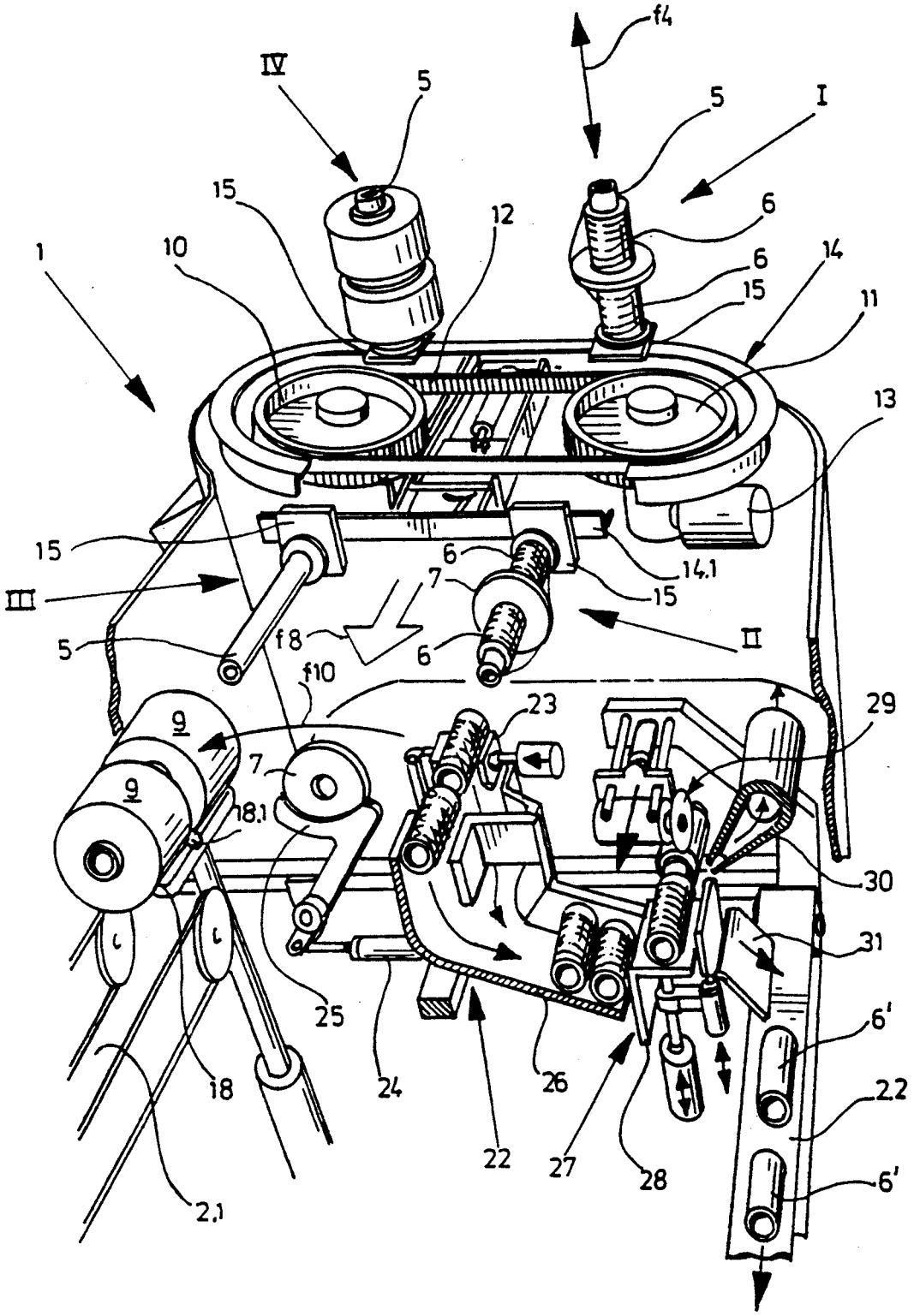
FIG. 3 shows partially in section an isometric representation of the bobbin transfer device in accordance with the invention in association with a sleeve removal and sleeve cleaning mechanism.

FIG. 3 shows a state in which in the work positions I and II the bobbin adapters 5 carry bobbin sleeves 6 partially wound with yarn residues, whilst the bobbin adapter 5 in the work position III is empty and thus ready for the acceptance of completely wound yarn bobbins 9. The rail portion 14.1 is in this respect shown in the position swung out of the guide rail 14.

By running-out of the rail portion 14.1 in the direction of the arrow f8, in the work position II the bobbin adapter 5 with the empty sleeves 6 superimposed thereon and with the run-out aid 7 is moved into the region of the sleeve removal mechanism 22. This mechanism 22 contains clamping jaws 23 which are adjustable in the horizontal direction and between which the bobbin adapter 5 with the empty sleeves 6 is run in, in such a way that by running together of the two clamping jaws 23 the in itself lower sleeve 6 is held fast. Insofar as a run-off aid 7 is present, a gripper 25 swivellable by means of a lifting cylinder 24 is swung-in into a position underneath the run-off aid 7 still superimposed on the adapter 5. This gripper has the form of an upwardly-open arcuate plug-in channel. After that, by running-back of the rail portion 14.1, the bobbin adapter 5 held fast by the plug-in mandrel 15.1 of the carriage 15 can be withdrawn from the two empty sleeves 6.

The run-off aid 7 held by the gripper 25 can then, by swivelling of the gripper 25 in the direction of the arrow f10 be inserted between two full yarn bobbins 9 deposited on the lifting table 18. The lifting table 18, for this purpose, provided with a run-in slot 18.1 for the running-in of the gripper 25.

With the running-out of the rail portion 14.1, at the same time in the work position III the empty bobbin adapter 5 is run-in into the sleeves of the two yarn bobbins 9, namely possibly also into the run-off aid 7 having a central aperture. After the two bobbins 9 have been accepted by the bobbin adapter 5 in the region of the work position III, the lifting table 18 is lowered, in order to be able afresh to accept a bobbin group, consisting of two bobbins 9, from the conveyor belt 2.1.

After the running-back of the rail portion 14.1 and after the swinging-back into the guide rail 14, the closed driving circuit is established once more, so that the transportation member 12 can be further stepped-on by one work step, in order to move the individual carriages 15 into the respectively following work positions.

After, in the region of the work position II, the two empty sleeves have been stripped off from the bobbin adapter, the upper sleeve 6 lying to the front in FIG. 3 drops directly into a sleeve magazine 26, whilst the lower sleeve 6 butting against the adapter foot drops, after opening of the clamping jaws 23, into the same magazine. The sleeves 6 present in the magazine 26 and possibly still partially wound are taken-over successively by a lifting table 28, run up and transferred to an expanding mandrel which grasps the sleeve from the inside and clamps it fast by expansion. After that the diagrammatically shown cutting mechanism 29 is activated, which has a rotating separating knife. By running the separating knife along a generatrix of the sleeve 6 held fast by means of the expanding mandrel, thread layers still present on the sleeve are severed, which can be sucked away by means of the suction mechanism and be carried away. After the cutting mechanism 29 has run back again into its initial, position, the sleeve 6 is released by the expanding mandrel.

During the lowering of the lifting table 28 for the purpose of acceptance of a further sleeve from the sleeve magazine 26, the cleaned sleeve 6' is transferred, by opening a lateral flap 31, from the lifting table laterally onto the conveyor belt 2.2, so that the cleaned sleeves 6' can then be supplied again in accordance with FIG. 1 to the individual winding points of the winding machine 2.

Simultaneously with the sleeve cleaning, fully wound yarn bobbins 9 are conveyed onto the lifting table 18 and after running-up of the lifting table 18 are brought into a position in which they can be received afresh by a following empty bobbin adapter 15. After depositing of two yarn bobbins 9 on the lifting table 18, a new run-off aid 7 is, as described, inserted between the two yarn bobbins 9.

Figure 4:
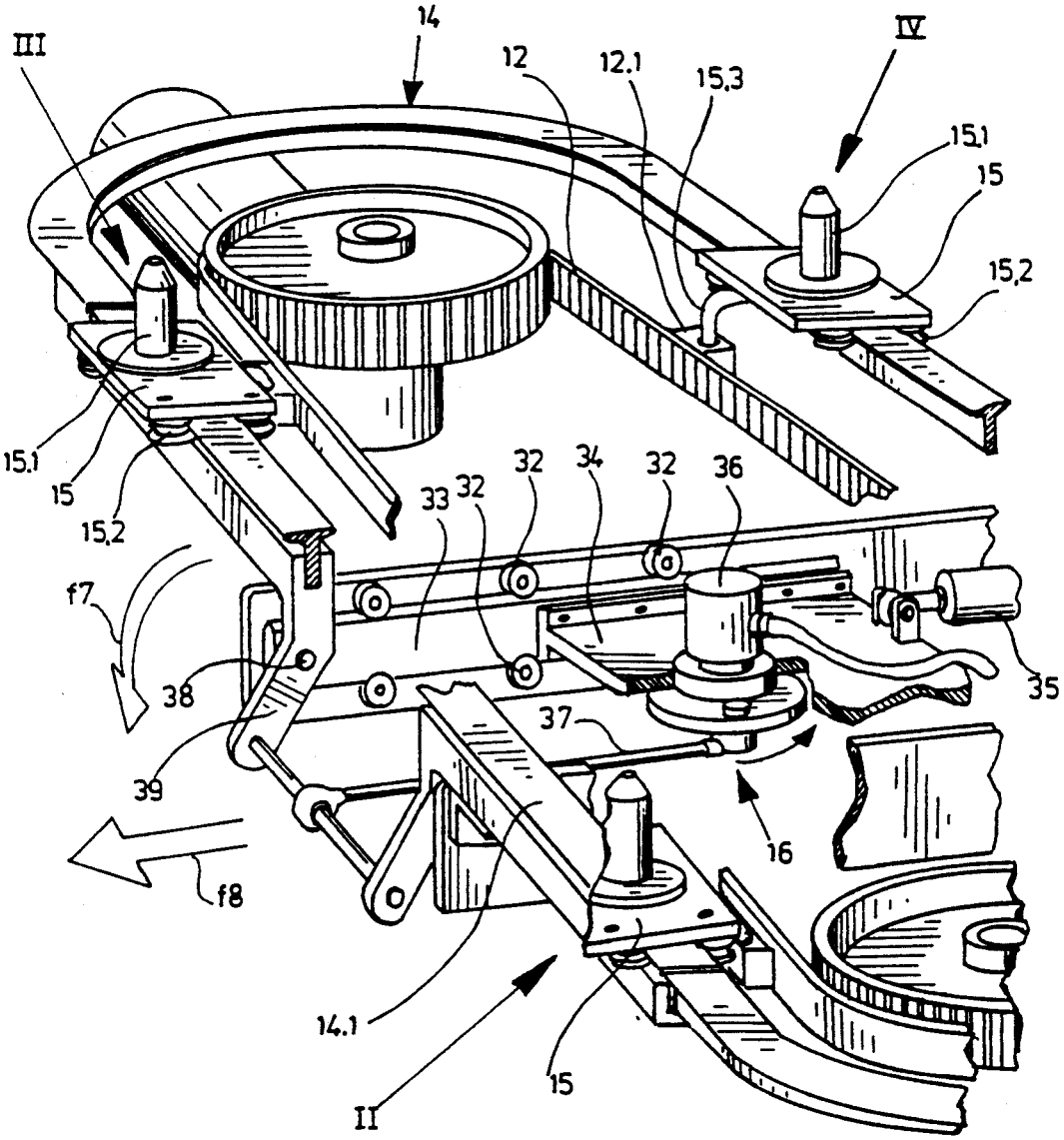
FIG. 4 shows in enlarged representation an isometric view of a part of the bobbin transfer device in accordance with the invention to make clear specific individual units of the same.
Figure 6:
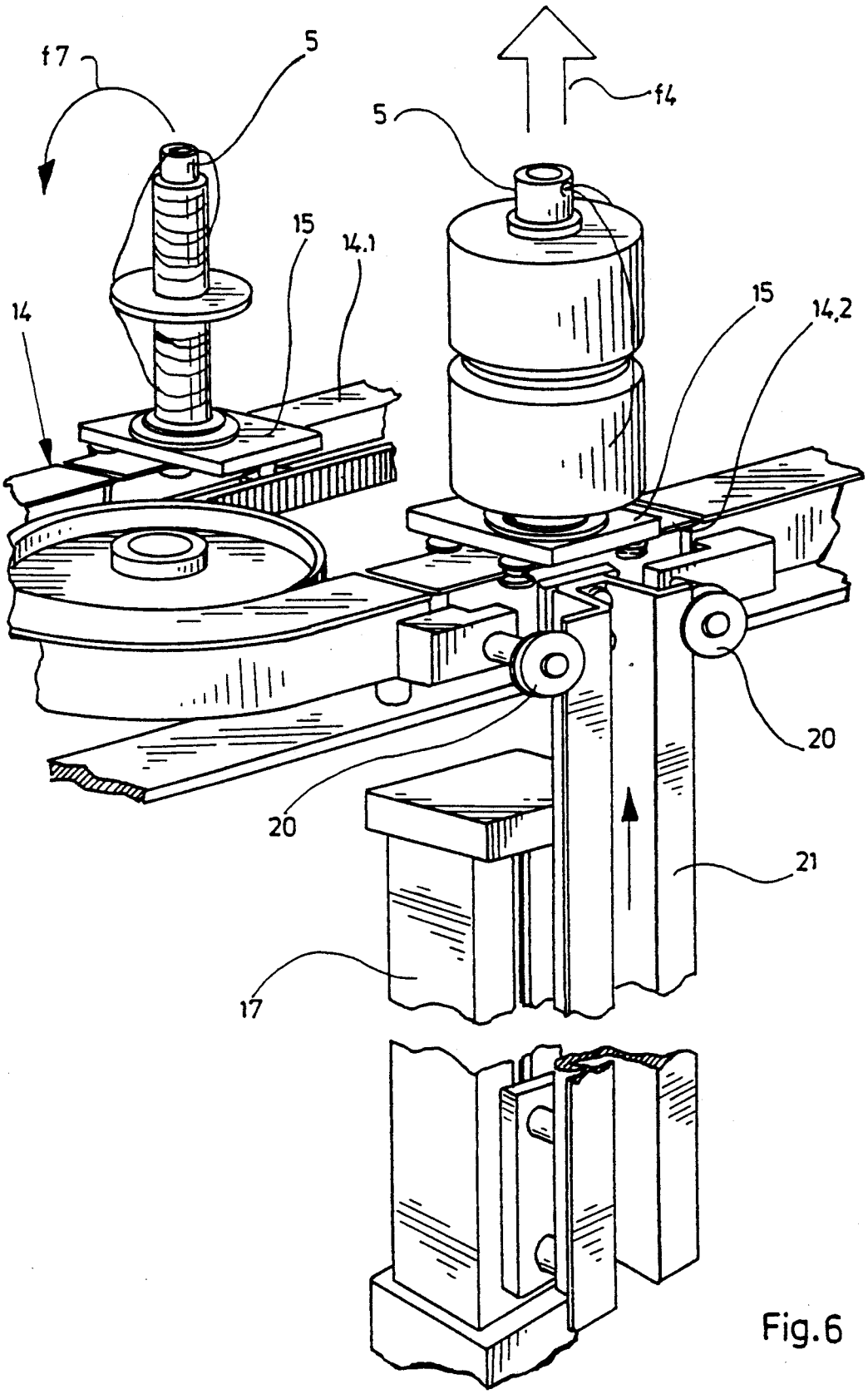
FIG. 6 shows a detailed view of a work station of the bobbin transfer device in accordance with the invention.

FIG. 4 shows the adjusting system 16 for swinging the rail portion 14.1 out of the conveying path formed by the guide rail 14 and for the horizontal displacement of this guide portion in the direction of the arrow f8. This adjusting system consists of carriages, displaceable between guide rollers 32, in the form of two horizontal rails 33 (in FIG. 4 only one of these horizontal rails is shown) and a cross-traverse 34 fastened between these horizontal rails 33. A swingably mounted lifting cylinder 35 acts on the rear end of this cross-traverse 34. Mounted on the cross-traverse 34 is, furthermore, a crank drive 36 for a connecting rod 37. This connecting rod 37 acts with its front end on the one lever arm of a lever system 39 which is swivellable about the horizontal axis 38 and on the second lever arm of which the rail portion 14.1 is positioned.

By activating the crank drive 36, the rail portion 14.1 can be swung about the horizontal axis 38 out of the conveying path formed by the guide rail 14. By activating the lifting cylinder 35 this rail portion 14.1 can be run-out in the direction of the arrow f8 in the horizontal direction, in order to be able to carry out the work steps in the work positions II and III.

Figure 5:
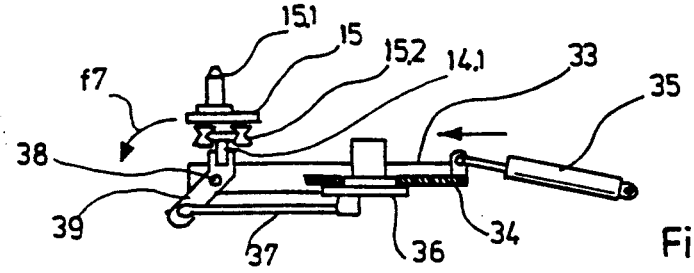
FIG. 5 shows partially in section a side view of an individual unit of the device in accordance with the invention.

The adjusting mechanism 10 is shown once again diagrammatically in FIG. 5.

The special feature of the operating method in accordance with the invention and of the device in accordance with the invention lies more particularly in that the individual work steps are distributed over four work positions or respectively work cycles. Thus, the performance of the transfer device can be increased considerably, in that one bobbin preparation station can supply several bobbin preparation machines as well as also several further-processing textile machines, for example two-for-one twisting machines.

What is claimed is:

1. A bobbin transfer apparatus for simultaneously transferring consecutive fully wound bobbins of yarn and substantially empty bobbins of yarn between a yarn bobbin winding machine adjacent said transfer apparatus and a bobbin suspension transporting mechanism positioned over said transfer apparatus, said bobbin suspension transporting mechanism consecutively transporting full bobbins form said transfer apparatus to a yarn processing machine and returning substantially empty bobbins therefrom to said transfer apparatus, said transfer apparatus comprising:

conveying means for consecutively conveying individual adapters for receiving said fully wound bobbins of yarn and said substantially empty bobbins of yarn, in a generally vertical position in a predetermined direction along a closed path of travel and consecutively through a plurality of work stations comprising;

a first work station positioned adjacent the closed path of travel of said conveying means and including means for moving up and down between said conveying means and the bobbin suspension transporting mechanism and for consecutively receiving and carrying adapters with a full yarn bobbin thereon from said conveying means to the transporting mechanism during upward movement thereof and for consecutively receiving and carrying adapters with a substantially empty bobbin thereon from the transporting mechanism to said conveying means during downward movement thereof;

a second work station positioned adjacent the closed path of travel of said conveying means and including means for consecutively receiving the adapters with the substantially empty bobbin from said first work station and for removing the substantially empty bobbin form the adapters for return to the winding machine; and a third work station positioned adjacent the closed path of travel of said conveying means and including means for consecutively receiving the empty adapters from said second work station and for mounting a fully wound bobbin of yarn from the winding machine onto the empty adapters, so that the adapters with the full bobbin thereon may be conveyed by said conveying means to said first work station for transfer to the transporting mechanism.

2. A bobbin transfer apparatus, as set forth in claim 1, in which said conveying means includes a guide rail in the shape of the closed path of travel, a plurality of carriages mounted for consecutive movement on and around said guide rail and each including a generally vertically-extending mandrel for extending into and carrying an individual adapter, and means for driving the respective carriages around said guide rail and to each the work stations.

3. A bobbin transfer apparatus, as set forth in claim 2, in which said means for driving the respective carriages around said guide rail comprises a driven endless conveyor belt means positioned within the closed path of travel of said guide rail and individual coupling means extending from said conveyor belt means to each of said carriages.

4. A bobbin transfer mechanism, as set forth in claim 2, in which said guide rail comprises an independent pivotable section adjacent said second and third work stations, said independent section of said guide rail being adapted to receive one of said carriages with an adapter having a substantially empty bobbin thereon on a first portion of said independent guide rail section adjacent said second work station and one of said carriages with an empty adapter having the bobbin removed on a second portion of said independent guide rail section adjacent said third work station, means for mounting and pivoting said independent guide rail section and carriages thereon approximately 90° from their vertical conveying position to a generally horizontal position, means for mounting and moving said guide rail section after the pivoting movement in a linear reciprocating forward and reverse generally horizontal direction, means to remove the substantially empty bobbin from the adapter having the substantially empty bobbin thereon in said second work station during the horizontal reciprocating movement of said guide rail section, and means for positioning a fully wound bobbin on the empty adapter having the bobbin removed in said third work station during the horizontal reciprocating movement of said guide rail section.

5. A bobbin transfer apparatus, as set forth in claim 4, in which said means for mounting and pivoting said guide rail section comprises a driven crank and lever means connected to said pivotally mounted guide rail section, and in which said means for mounting and moving said guide rail section in a reciprocating forward and reverse generally horizontal direction comprises a horizontally-extending roller and rail means mounting said guide rail section and a fluid-operated piston and cylinder mechanism connected thereto.

6. A bobbin transfer apparatus, as set forth in claim 4 or 5, in which said means to remove the substantially empty bobbin from the adapter in said second work station means comprises clamp means for clamping the substantially empty bobbin during the forward movement of said guide rail section and for releasing the bobbin after rearward movement of said rail section, and a magazine means for receiving the bobbin after release by said clamp means.

7. A bobbin transfer apparatus, as set forth in claim 6, further including means for removing the substantially empty bobbin from said magazine means, means for cutting and removing the residual yarn from the bobbin and means for releasing the totally empty bobbin to the winding machine.

8. A bobbin transfer apparatus, as set forth in claim 4 or 5, in which said means for positioning a fully wound bobbin on the empty adapter in said third work station comprises elevation means for receiving fully wound bobbins from the winding machine in a generally horizontal position at a first elevation and positioning such bobbin at a second elevation for receipt of the empty adapter therein during the forward movement of said guide rail section.

9. A bobbin transfer apparatus, as set forth in claim 4 or 5, in which said means to remove the substantially empty bobbin from the adapter in said second work station comprises clamp means for clamping the substantially empty bobbin during the forward movement of said guide rail section and for releasing the bobbin after rearward movement of said guide rail section, and a magazine means for receiving the bobbin after release by said clamp means; and in which said means for positioning a fully wound bobbin on the empty adapter in said third work station comprises elevation means for receiving fully wound bobbins from the winding machine in a generally horizontal position at a first elevation and positioning such bobbin at a second elevation for receipt of the empty adapter therein during the forward movement of said guide rail section.

10. A bobbin transfer apparatus, as set forth in claim 2, in which said means for moving up and down of said first work station comprises an independent guide rail section for receiving one of said carriages and mounted for up and down movement from and to the remaining portion of said guide rail, and drive means for effecting such up and down movement.

11. A bobbin transfer apparatus, as set forth in claim 1, 2 or 10, in which said bobbin transfer apparatus further includes a forth work station including means for consecutively receiving the adapters with the at least one full bobbin of yarn thereon from said third work station means and before conveying to said first work station means and for grasping and positioning the loose yarn end from the bobbin at a desired position on the adapter for further handling.

* * * * *

UNITED STATES PATENT AND TRADEMARK OFFICE

CERTIFICATE OF CORRECTION

PATENT NO. : 5,207,051

DATED : May 4, 1993

INVENTOR(S) : Inger et al.

It is certified that error appears in the above-identified patent and that said Letters Patent is hereby corrected as shown below:

Title page, item (56):

Under References Cited,

"4,571,931 2/1986 Kupper" should be --4,571,931 2/1986 Küpper--.

"4,979,360 12/1990 Kaumann" should be --4,979,360 12/1990 Kallmann--.

"5,011,000 4/1992 Rawasaki et al." should be --5,011,000 4/1992 Kawasaki et al.--.

At Column 1, line 46, delete "4,586,320" and substitute --4,586,326-- therefor.

At Column 3, line 27, delete "form" and substitute --from-- therefor.

At Column 5, line 10, delete "Which" and substitute --which-- therefor.

At Column 6, line 10, after "moved" delete --,--.

At Column 6, line 23, delete "Work" and substitute --work-- therefor.

At Column 8, line 43, delete "form" and substitute --from-- therefor.

UNITED STATES PATENT AND TRADEMARK OFFICE

CERTIFICATE OF CORRECTION

PATENT NO. : 5,207,051

DATED : May 4, 1993

INVENTOR(S) : Inger, et al.

It is certified that error appears in the above-indentified patent and that said Letters Patent is hereby corrected as shown below:

Column 10, line 41, delete "forth" and insert --fourth--.

Signed and Sealed this

First Day of February, 1994

Bruce Lehman

*Attest:*

BRUCE LEHMAN

*Attesting Officer*

*Commissioner of Patents and Trademarks*